United States Patent [19]

Okado et al.

[11] Patent Number: 4,996,118

[45] Date of Patent: Feb. 26, 1991

[54] COMPOSITE METAL PLATED ARTICLE EXCELLENT IN MOLD-RELEASABILITY

[75] Inventors: Akiyoshi Okado; Masaki Abe; Hiroshi Kagechika; Shinichi Kagaya, all of Tokyo, Japan

[73] Assignee: NKK Corporation, Tokyo, Japan

[21] Appl. No.: 528,935

[22] Filed: May 25, 1990

[30] Foreign Application Priority Data

Jun. 22, 1989 [JP] Japan ..... 1-159892

[51] Int. Cl.[5] ..... B32B 15/00; B32B 15/01; B32B 15/04

[52] U.S. Cl. ..... 428/639; 428/432; 428/433; 428/434; 428/457

[58] Field of Search ..... 428/639, 432, 433, 434, 428/457

[56] References Cited

FOREIGN PATENT DOCUMENTS

| | | |
|---|---|---|
| 49-120959 | 11/1974 | Japan . |
| 51-17249 | 2/1976 | Japan . |
| 60-48599 | 10/1985 | Japan . |
| 62-215098 | 9/1987 | Japan . |
| 1-33177 | 2/1989 | Japan . |

*Primary Examiner*—R. Dean
*Assistant Examiner*—David W. Schumaker
*Attorney, Agent, or Firm*—Frishauf, Holtz, Goodman & Woodward

[57] ABSTRACT

A composite metal plated article excellent in mold-releasability, which comprises an article to be plated and a composite metal plating layer, formed on at least one surface of the article to be plated, in which particles of a synthetic resin as a mold-releasing agent are uniformly dispersed. The above-mentioned synthetic resin comprises a modified silicone oil having a structure in which a plurality of repeated units of a fluorine atoms substituted olefin are combined with silicone oil.

7 Claims, 1 Drawing Sheet

COMPOSITE METAL PLATED ARTICLE EXCELLENT IN MOLD-RELEASABILITY

REFERENCE TO PATENTS, APPLICATIONS AND PUBLICATIONS PERTINENT TO THE INVENTION

As far as we know, there is available the following prior art document pertinent to the present invention:

Japanese Patent Publication No.60–48,599 dated Oct. 28, 1985.

The contents of the prior art disclosed in the above-mentioned prior art document will be discussed hereafter under the heading of the "BACKGROUND OF THE INVENTION".

FIELD OF THE INVENTION

The present invention relates to a composite metal plated article excellent in mold-releasability.

BACKGROUND OF THE INVENTION

In general, the inner surface of any of various molds such as those for metal forming and plastics forming is in contact with molten metal or molten plastics, which has a high adhesion. An excellent mold-releasability of the inner surface is therefore required for these molds.

When a press is used for firmly bonding a plurality of sheets, for example, two sheets to each other by means of an adhesive, the adhesive between the two sheets tends to be pressed out of the edges of these sheets and adhere to a pair of pressing portions of the press. When bonding the two sheets to each other with the use of the press as described above, therefore, it is the usual practice to arrange separating plates between the two sheets to be bonded and the pair of pressing portions of the press to prevent the adhesive between the two sheets from adhering to the pair of pressing portions of the press. These separating plates used for this purpose are also required to have an excellent mold-releasability as in the case of the above-mentioned mold.

It has therefore been tried to provide a composite metal plated article excellent in mold-releasability and thus suitable for use as the above-mentioned mold or separating plate, by causing particles of various inorganic or organic substance as a mold-releasing agent to uniformly disperse in a metal plating layer of nickel, chromium or the like formed on the surface of an article to be plated, so as to form a composite metal plating layer thereon.

A composite metal plated article excellent in mold-releasability is disclosed in Japanese Patent Publication No. 60–48,599 dated Oct. 28, 1985 (hereinafter referred to as the "prior art"), which comprises: an article to be plated and a composite metal plating layer, formed on at least one surface of the article to be plated, in which particles of polytetrafluoroethylene as a mold-releasing agent or particles of tetrafluoroethylene-perfluoroalkylvinylether copolymer as a moldreleasing agent are uniformly dispersed.

In the composite metal plated article of the prior art, the particles of polytetrafluoroethylene or the particles of tetrafluoroethylene-perfluoroalkylvinylether copolymer, which are uniformly dispersed in the composite metal plating layer, impart mold-releasability to the surface of the composite metal plating layer.

However, the above-mentioned composite metal plated article of the prior art has the following drawbacks:

(1) The composite metal plated article of the prior art has a low ratio of the exposed surface area of the particles of polytetrafluoroethylene as the mold-releasing agent or the particles of tetrafluoroethylene-perfluoroalkylvinylether copolymer as the mold-releasing agent to the total surface area of the composite metal plating layer (hereinafter referred to as the "resin coverage ratio"). The composite metal plated article of the prior art is therefore low in mold-releasability in an as-plated state.

(2) In order to increase the resin coverage ratio and thus to impart a satisfactory mold-releasability to the surface of the composite metal plating layer, therefore, it is necessary to apply a heat treatment to the composite metal plated article of the prior art, i.e., heating the composite metal plated article to a temperature of about 350° C. to melt the particles of polytetrafluoroethylene as the mold-releasing agent or the particles of tetrafluoroethylene-perfluoroalkylvinylether copolymer as the mold-releasing agent exposed on the surface of the composite metal plating layer, thereby forming a film of polytetrafluoroethylene or tetrafluoro- ethylene-perfluoroalkylvinylether copolymer on the surface of the composite metal plating layer.

(3) If the above-mentioned heat treatment is carried out in the open air, oxides are produced on the surface of the composite metal plating layer, thus deteriorating the external appearance of the composite metal plated article.

(4) In order to prevent the above-mentioned formation of the oxides on the surface of the composite metal plating layer, it is necessary to carry out the above-mentioned heat treatment in an atmosphere comprising nitrogen gas or other inert gas. The heat treatment in such an inert gas atmosphere is very complicated, thus requiring a high production cost.

Under such circumstances, there is a strong demand for the development of a composite metal plated article which does not require a heat treatment, has an excellent mold-releasability in an as-plated state, is beautiful in external appearance, and requires only a low production cost, but such a composite metal plated article has not as yet been proposed.

SUMMARY OF THE INVENTION

An object of the present invention is therefore to provide a composite metal plated article which does not require a heat treatment, has an excellent mold-releasability in an as-plated state, is beautiful in external appearance, and requires only a low production cost.

In accordance with one of the features of the present invention, there is provided, in a composite metal plated article excellent in mold-releasability, which comprises an article to be plated and a composite metal plating layer, formed on at least one surface of said article to be plated, in which particles of a synthetic resin as a mold-releasing agent are uniformly dispersed, the improvement characterized in that: said synthetic resin comprises a modified silicone oil having a structure in which a plurality of repeated units of a fluorine atoms substituted olefin are combined with silicone oil.

DETAILED DESCRIPTION OF PREFERRED EMBODIMENTS

Figure 1:
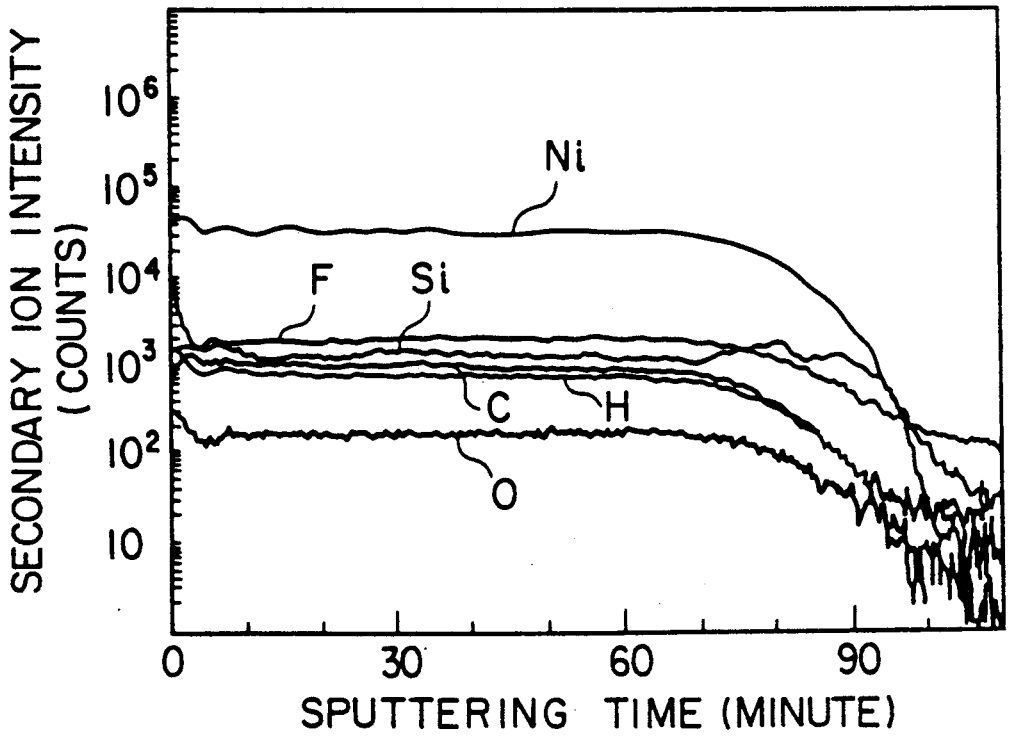
FIG. 1 is a graph illustrating the relationship, when analyzing a composite metal plating layer of the composite metal plated article of the present invention with the use of a secondary ion mass spectrometer, between intensity of secondary ions released from individual elements in the composite metal plating layer and a sputtering time.

From the above-mentioned point of view, extensive studies were carried out to develop a composite metal plated article which does not require a heat treatment, has an excellent mold-releasability in an as-plated state, is beautiful in external appearance, and requires only a low production cost.

As a result, the following findings were obtained: in a composite metal plated article, which comprises an article to be plated and a composite metal plating layer, formed on at least one surface of the article to be plated, in which particles of a synthetic resin as a mold-releasing agent are uniformly dispersed, it is possible to obtain a composite metal plated article which does not require a heat treatment, has an excellent mold-releasability in an as-plated state, is beautiful in external appearance, and requires only a low production cost, by using particles of a modified silicone oil having a structure in which a plurality of repeated units of a fluorine atoms substituted olefin are combined with silicone oil, as the particles of the above-mentioned synthetic resin.

The present invention was made on the basis of the above-mentioned findings. The composite metal plated article excellent in mod-releasability of the present invention is described below.

The composite metal plated article excellent in mold-releasability of the present invention comprises an article to be plated and a composite metal plating layer, formed on at least one surface of the article to be plated, in which particles of a synthetic resin as the mold-releasing agent are uniformly dispersed. The synthetic resin as the mold-releasing agent comprises a modified silicone oil having a structure in which a plurality of repeated units of a fluorine atoms substituted olefin are combined with silicone oil (hereinafter referred to as the "fluorine-modified silicone oil").

The article to be plated is used as an article required to have an excellent mold-releasability, such as a separating plate used in combination with a press or a mold for forming plastics. The article to be plated is formed of metal such as steel, aluminum, or copper, or plastics or ceramics.

The composite metal plated article excellent in mold-releasability of the present invention is manufactured by subjecting the above-mentioned article to be plated to an electroplating in a composite electroplating bath prepared by causing the particles of fluorine-modified silicone oil to suspend in an electroplating solution, or, by subjecting the above-mentioned article to be plated to a dip-plating in a composite dip-plating bath prepared by causing the particles of fluorine-modified silicone oil to suspend in a dip-plating solution.

In the composite metal plated article excellent in mold-relesability of the present invention, metal in the composite metal plating layer formed on the surface of the article to be plated comprises any one selected from the group consisting of nickel, chromium, cobalt, copper, lead, silver and tin.

In the composite metal plated article excellent in mold-releasability of the present invention, furthermore, metal in the composite metal plating layer formed on the surface of the article to be plated may comprise an alloy comprising any one selected from the group consisting of nickel, chromium, cobalt, copper, lead, silver and tin, on the one hand, and another one selected from the group consisting of phosphorus and boron, on the other hand.

The particles of fluorine-modified silicone oil uniformly dispersed in the composite metal plating layer of the composite metal plated article excellent in mold-releasability of the present invention have a function of imparting mold-releasability to the composite metal plating layer. However, with a content ratio of under 5 vol.% of the particles of fluorine-modified silicone oil to the composite metal plating layer, a desired effect as described above cannot be obtained. With a content ratio of over 40 vol.% of the particles of fluorine-modified silicone oil to the composite metal plating layer, on the other hand, adhesion of the composite metal plating layer to the surface of the article to be plated is deteriorated. The content ratio of the articles of fluorine-modified silicone oil to the composite metal plating layer should therefore be limited within the range of from 5 to 40 vol.%.

An average molecular weight of the particles of fluorine-modified silicone oil exerts an important effect on mold-releasability of the composite metal plating layer formed on the surface of the article to be plated. With an average molecular weight of fluorine-modified silicone oil of under 100, stability of the composite electroplating bath or the composite dis-plating bath (hereinafter simply referred to as the "composite plating bath") decreases, thus making it difficult to uniformly disperse the particles of fluorine-modified silicone oil in the composite metal plating layer. With an average molecular weight of fluorine-modified silicone oil of over 100,000, on the other hand, the particles of fluorine-modified silicone oil tend to more easily settle in the composite plating bath, thus leading to a lower precipitation efficiency of the particles of fluorine-modified silicone oil on the surface of the article to be plated. The average molecular weight of the particles of fluorine-modified silicone oil should therefore be limited within the range of from 100 to 100,000, and more preferably, within the range of from 1,000 to 20,000.

When manufacturing the composite metal plated article excellent in mold-releasability of the present invention, any of the various known plating solutions may be used. As the electroplating solution, for example, an electro-nickel plating solution such as a nickel sulfamate plating solution, a nickel borofluoride plating solution or a Watt plating solution, and an electro-cobalt plating solution such as a cobalt sulfate plating solution, or a cobalt chloride plating solution, may be used. As the dip-plating solution, for example, any of a nickel dip-plating solution, a cobalt dip-plating solution and a copper dip-plating solution, each containing a reducing agent such as hypophosphoruous acid or dimethylamineborane, may be used.

The composite plating bath is prepared by mixing the particles of fluorine-modified silicone oil as the mold-releasing agent, which have been emulsified by a surfactant, into any of the above-mentioned electroplating solution and dip-plating solution and stirring the resultant mixture. Particles of the fluorine-modified silicone oil as the mold-releasing agent are suspended in the thus prepared composite plating bath.

An amount of the particles of fluorine-modified silicone oil in the composite plating bath exerts an important effect on a production efficiency of the composite metal plated article excellent in mold-releasability of the present invention. With an amount of under lg/l of the particles of fluorine-modified silicone oil in the composite plating bath, a precipitation efficiency of the particles of fluorine-modified silicone oil on the surface of the article to be plated decreases. With an amount of over 500 g/l of the particles of fluorine-modified silicone oil in the composite plating bath, on the other hand, the composite plating bath becomes unstable, and in an extreme case, the composite plating bath is converted into gel. The amount of the particles of fluorine-modified silicone oil in the composite plating bath should therefore be limited within the range of from 1 to 500 g/l , more preferably, within the range of from 5 to 200 g/l , and further more preferably, within the range of from 10 to 100 g/l .

An additive such as a glossing agent or a softening agent is added as required to the above-mentioned composite plating bath. Particles of another substance may be added to the composite plating bath in order to impart a property other than mold-releasability to the composite metal plating layer, for example, particles of silicon carbide may be added to the composite plating bath in order to impart an excellent wear resistance to the composite metal plating layer.

When the article to be plated is formed of plastics or ceramics, the electroplating cannot be applied to this kind of article to be plated. Prior to application of the electroplating to the article to be plated, which is formed of plastics or ceramics, therefore, it is necessary to apply a treatment for forming an electrically conductive film on the surface of the article to be plated, for example, to apply the dip-plating to the article to be plated, thereby forming a metal plating film on the surface of the article to be plated.

Now, the composite metal plated article excellent in mold-releasability of the present invention is described further in detail by means of examples while comparing with cases for comparison:

EXAMPLES

First, samples of the present invention Nos. 1 to 5 were prepared in accordance with the following method.

More specifically, a steel sheet was subjected to an electroplating under the following conditions:

(1) Chemical composition of composite electroplating bath:
Nickel sulfamate: 350 g/l,
Nickel chloride: 15 g/l,
Boric acid 30 g/l , and
Particles of fluorine-modified silicone oil
(average molecular weight: 1,000 to 2,000): 50 g/l,
(2) Electric current density: 2 A/dm$^2$,
(3) Bath temperature: 40° C.,
(4) pH value: 4.0,
(5) Electroplating time: 25 minutes, to form, on the surface of the steel sheet, a composite metal plating layer having a thickness of 10 μm, in which the particles of fluorine-modified silicone oil, as the mold-releasing agent, were uniformly dispersed, thereby preparing a sample of the present invention No.1.

A steel sheet was subjected to a dip-plating under the following conditions:

(1) Chemical composition of composite dip-plating bath:
Nickel sulfate: 50 g/l,
sodium hypophosphite: 100 g/l,
Ammonium citrate: 100 b/l, and
Particles of fluorine-modified silicone oil
(average molecular weight: 1,000 to 2,000): 50 g/l,
(2) Bath temperature: 30° C.,
(3) pH value: 10
(4) Dipping time: 60 minutes, to form, on the surface of the steel sheet, a composite metal plating layer having a thickness of 10 μm, in which the particles of fluorine-modified silicone oil, as the mold-releasing agent, where uniformly dispersed, thereby preparing a sample of the present invention No. 2.

A steel sheet was subjected to an electroplating under the following conditions:

(1) Chemical composition of composite electroplating bath:
Copper sulfate: 200 g/l,
Sulfurio acid: 50 g/l, and
Particles of fluorine-modified silicone oil (average molecular weight: 1,000 to 2,000): 30 g/l,
(2) Electric current density: 3 A/dm$^2$,
(3) Bath temperature: 25° C.,
(4) Electroplating time: 17 minutes, to form, on the surface of the steel sheet, a composite metal plating layer having a thickness of 10 μm, in which particles of fluorine-modified silicone oil, as the mold-releasing agent, were uniformly dispered, thereby preparing a sample of the present invention No. 3.

A steel sheet was subjected to an electroplating under the following conditions:

(1) Chemical composition of composite electroplating bath:
Nickel sulfamate: 350 g/l,
Nickel chloride: 15 g/l,
Boric acid: 30 g/l, and
Particles of fluorine-modified silicone oil (average molecular weight: 1,000 to 2,000): 10 g/l,
(2) Electric current density: 2 A/dm$^2$,
(3) Bath temperature: 40° C.,
(4) pH value: 4.0,
(5) Electroplating time: 25 minutes, to form, on the surface of the steel sheet, a composite metal plating layer having a thickness of 10 μm, in which the particles of fluorine-modified silicone oil, as the mold-releasing agent, where uniformly dispersed, thereby preparing a sample of the present invention No. 4.

A steel sheet was subjected to an electroplating under the following conditions:

(1) Chemical composition of composite electroplating bath:
Nickel sulfamate: 350g/l,
Nickel chloride: 15g/l,
Boric acid:30g/l, and
Particles of fluroine-modified silicone oil (average molecular weight: 1,000 to 2,000): 100g/l,
(2) Electric current density: 2A/dm$^2$,
(3) Bath temperature: 40° C.,
(4) H value: 4.0,
(5) Electroplating time: 25 minutes, to form, on the surface of the steel sheet, a composite metal plating layer having a thickness of 10 μm, in which the particles of fluorine-modified silicone oil, as the mold-releasing agent, were uniformly dispersed, thereby preparing a sample of the present invention No. 5.

Then, samples for comparison Nos. 1 to 4 outside the scope of the present invention were prepared for comparison purposes in accordance with the following method.

More specifically, a steel sheet was subjected to an electroplating under the following conditions:

(1) Chemical composition of composite electroplating bath:

Nickel sulfate: 240g/l,

Nickel chloride: 45g/l,

Boric acid: 30g/l, and Particles of tetrafluoroethylene-perfluoroalkylvinylether copolymer (average particle size: 0.2 to 0.5 μM):50g/l, (2) Electric current density: 5 A/dm$^2$, (3) Bath temperature: 60° C., (4) pH value: 3.0, (5) Electroplating time: 10 minutes, to form, on the surface of the steel sheet, a composite metal plating layer having a thickness of 10 μm, in which the particles of tetrafluoroethylene-perfluoroalkylvinylether copolymer, as the mold-releasing agent, were uniformly dispersed, thereby preparing a sample for comparison No. 1.

A steel sheet was subjected to an electroplating under the following conditions:

(1) Chemical composition of composite electroplating bath:

Nickel sulfamate: 350 g/l,

Nickel chloride: 15 g/l,

Boric acid: 30 g/l, and Particles of fluorine-modified silicone oil

Particles of polytetrafluoroethylene (average particle size: 0.2 to 0.5 μm): 100g/l, (2) Electric current density: 2 A/dm$^2$, (3) Bath temperature: 40° C., (4) pH value: 4.0, (5) Electroplating time: 10 minutes, to form, on the surface of the steel sheet, a composite metal plating layer having a thickness of 10 μm, in which the particles of polytetrafluoroethylene, as the mold-releasing agent, where uniformly dispersed, thereby preparing a sample for comparison No. 2.

A steel sheet was subjected to a dip-plating under the following conditions: (1) Chemical composition of composite dip-plating bath:

Nickel sulfate: 35g/l,

Sodium citrate: 20 g/l, sodium hydroxide: 40g/l,

Sodium borohydride: 0.45g/l, and

Particles of polytetrafluoroethylene (average particle size: 0.2 to 0.5 μm) :30 g/l, (2) Bath temperature: 90° C., (3) pH value: 14, (4) Dipping time: 60 minutes, to form, on the surface of the steel sheet, a composite metal plating layer having a thickness of 10 μm, in which the particles of polytetrafluoroethylene, as the mold-releasing agent, were uniformly dispersed, thereby preparing a sample for comparison No. 3.

a steel sheet was subjected to an electroplating under the following conditions:

(1) Chemical composition of composite electroplating bath:

Copper sulfate: 200 g/l,

Sulfuric acid: 50 g/l, and

Particles of tetrafluoroethylene-perfluoroalkylvinylether copolymer (average particle size: 0.2 to 0.5 μm): 30 g/l, (2) Electric current density: 3 A/dm$^2$, (3) Bath temperature: 25° C., (4) Electroplating time: 17 minutes, to form, on the surface of the steel sheet, a composite metal plating layer having a thickness of 10 μm, in which the particles of tetrafluoroethylene-perfluoroalkylvinylether copolymer, as the mold-releasing agent, where uniformly dispersed, thereby preparing a sample for comparison No. 4.

For each of the samples of the present invention Nos. 1 to 5 and the samples for comparison Nos. 1 to 4 outside the scope of the present invention, the main constituent elements of the composite metal plating layer, the kind of particles of the mole-releasing agent uniformly dispersed in the composite metal plating layer, and the content ratios of the particles of the mold-releasing agent to the composite metal plating layer are shown in Table 1.

TABLE 1

| No. | Main constituent elements | Kind of mold-releasing agent | Content ratio of mold-releasing agent (vol. %) | Mold-releasability |
|---|---|---|---|---|
| | Sample of the present invention | | | |
| 1 | Ni | A | 20 | o |
| 2 | Ni-7.5 wt. % P | A | 20 | o |
| 3 | Cu | A | 15 | o |
| 4 | Ni | A | 5 | o |
| 5 | Ni | A | 40 | o |
| | Sample for comparison | | | |
| 1 | Ni | B | 20 | Δ |
| 2 | Ni | C | 30 | Δ |
| 3 | Ni-3.5 wt. % B | C | 15 | x |
| 4 | Cu | B | 15 | x |

Note:
The kinds of the mold-releasing agent are as follows:
A: Fluorine-modified silicone oil,
B: Tetrafluoroethylene-perfluoroalkylvinylether copolymer, and
C: Polytetrafluoroethylene.

On each of the composite metal plating layers of the samples of the present invention Nos. 1 to 5 and the samples for comparison Nos. 1 to 4 outside the scope of the present invention, a test regarding mold-releasability in an as-plated state was carried out as follows:

More particularly, a cloth impregnated with an epoxy resin was placed on the surface of the composite metal plating layer of each of the samples of the present invention Nos. 1 to 5 and the samples for comparison Nos. 1 to 4 . Then, the cloth impregnated with the epoxy resin was caused to closely adhere to the surface of the composite metal plating layer by heating same at a temperature of 200° C. under a pressure of 400 kg/cm$^2$ by means of a hot press tester. The above-mentioned heating to a temperature of 200° C. by means of the hot press tester to melt the epoxy resin and imparting adhesion thereto, did not melt the particles of the mold-releasing agent uniformly dispersed in the composite metal plating layer.

Then, the cloth impregnated with the epoxy resin closely adhering to the surface of the composite metal plating layer of each of the samples of the present invention Nos. 1 to 5 and the samples for comparison Nos. 1 top 4 was peeled off to evaluate mold-releasability in an as plated state of each composite metal plating layer on the basis of the peeloff state thereof. The result of this test regarding mold-releasability is shown in the column of "Mold-releasability" in Table 1.

The criteria for the evaluation of mold-releasability were as follows:

O: The cloth impregnated with the epoxy resin is very easily peeled off from the composite metal plating layer over the entire coverage thereof;

Δ: Most part of the cloth impregnated with the epoxy resin is relatively easily peeled off from the composite metal metal plating layer, whereas part thereof remains on the surface of the composite metal plating layer without being peeled off therefrom; and x: The cloth impregnated with the epoxy resin cannot be peeled off from the composite metal plating layer over the entire coverage thereof.

As shown in Table 1, all the samples of the present invention Nos. 1 to 5 are excellent in mold-releasability in an as-plated state.

In contrast, all the samples for comparison Nos. 1 top 4 are inferior to the samples of the present invention Nos. 1 to 5 in mold-releasability in an as-plated state. It is understood from these results that, in order to impart an excellent mold-releasability as in the samples of the present invention Nos. 1 to 5 to the samples for comparison Nos. 1 to 4, it is necessary to apply a heat treatment to each of the samples for comparison Nos. 1 to 4 to melt the particles of polytetrafluoroethylene or the particles of tetrafluoroethylene-perfluoroalkylvinylether copolymer exposed on the surface of the composite metal plating layer thereof, thereby forming a film of polytetrafluoroethylene or tetrafluoroethylene-perfluoroalkylvinylether copolymer on the surface of the composite metal plating layer.

For the purpose of confirming the constituent elements of the composite metal plating layer of the sample of the present invention No. 1, the composite metal plating layer thereof was analyzed by the use of a secondary ion mass spectrometer. The result of analysis is shown in FIG. 1. FIG. 1 is a graph illustrating the relationship, when analyzing the composite metal plating layer of the sample of the present invention No. 1 with the use of the secondary ion mass spectrometer, between intensity of secondary ions released from the individual elements in the composite metal plating layer and a sputtering time. In FIG. 1, the ordinate represents intensity (i.e., the number of counts) of secondary ions released from the individual elements in the composite metal plating layer during sputtering of the composite metal plating layer, and the abscissa represents the sputtering time of the composite metal plating layer. Intensity of secondary ions of each element corresponds to the quality of that element at the depth, at which sputtering is carried out, of the composite metal plating layer. The sputtering time corresponds to the depth, at which sputtering is carried out, of the composite metal plating layer.

As is evident from FIG. 1, the individual elements including fluorine (F), silicon (Si), nickel (Ni), carbon (C), hydrogen (H) and oxygen (O) are uniformly present over the entire thickness of the composite metal plating layer of the sample of the present invention No. 1. This reveals that the particles of fluorine-modified silicone oil as the mold-releasing agent are uniformly dispersed over the entire thickness of the composite metal plating layer of the sample of the present invention No. 1.

As described above, since the particles of fluorine-modified silicone oil as the mold-releasing agent are uniformly dispersed over the entire thickness of the composite metal plating layer of the sample of the present invention No. 1, the particles of fluorine-modified silicone oil as the mold-releasing agent are uniformly dispersed also on the surface of the composite metal plating layer, thus revealing that the composite metal plating layer of the sample of the present invention No. 1 has an excellent mold-releasability.

Analysis of the composite metal plating layer by means of the secondary ion mass spectrometer was applied also to the samples of the present invention Nos. 2 to 5. The result permitted confirmation that the particles of fluorine-modified silicone oil as the mold-releasing agent were uniformly dispersed in the composite metal plating layers of these samples as in the sample of the present invention No. 1.

According to the present invention, as described above in detail, it is possible to obtain a composite metal plated article which does not require a heat treatment, has an excellent mold-releasability in an as-plated state, is beautiful in external appearance and requires only a low production cost, thus providing many industrially useful effects.

What is claimed is:

1. In a composite metal plated article excellent in mold-releasability, which comprises an article to be plated and a composite metal plating layer, formed on at least one surface of said article to be plated, in which particles of a synthetic resin as a mold-releasing agent are uniformly dispersed, the improvement characterized in that:

said synthetic resin comprises a modified silicone oil having a structure in which a plurality of repeated units of a fluorine atoms substituted olefin are combined with silicone oil.

2. The composite metal plated article as claimed in claim 1, wherein:

said particles of said synthetic resin have an average molecular weight within the range of from 100 to 100,000.

3. The composite metal plated article as claimed in claim 1, wherein:

a content ratio of said particles of said shynthetic resin to said composite metal plating layer is within the range of from 5 to 40 vol.%.

4. The composite metal plated article as claimed in claim 1, wherein:

metal in said composite metal plating layer comprises any one selected from the group consisting of nickel, chromium, cobalt, copper, lead, silver and tin.

5. The composite metal plated article as claimed in claim 1, wherein:

metal in said composite metal plating layer comprises an alloy comprising any one selected from the group consisting of nickel, chromium, cobalt, copper, lead, silver and tin, on the one hand, and another one selected from the group consisting of phosphorus and boron, on the other hand.

6. The composite metal plated article as claimed in claim 1, wherein:

said article to be plated is formed of any one of metal, plastics and ceramics.

7. The composite metal plated article as claimed in claim 6, wherein:

said metal forming said article to be welded comprises any one of steel, aluminum and copper.

* * * * *